US005203292A

United States Patent [19]

Motose

[11] Patent Number: 5,203,292

[45] Date of Patent: Apr. 20, 1993

[54] WIRING ARRANGEMENT FOR ELECTRIC PARTS OF AN OUTBOARD MOTOR

[75] Inventor: Hitoshi Motose, Hamamatsu, Japan

[73] Assignee: Sanshin Kogyo Kabushiki Kaisha, Hamamatsu, Japan

[21] Appl. No.: 901,390

[22] Filed: Jun. 19, 1992

[30] Foreign Application Priority Data

Jul. 2, 1991 [JP] Japan ..... 3-188020

[51] Int. Cl.[5] ..... B63H 21/36; F02B 77/00

[52] U.S. Cl. ..... 123/143 C; 123/195 C; 123/195 E; 123/195 P; 123/198 E

[58] Field of Search ..... 123/143 C, 195 C, 195 E, 123/149 D, 198 E, 195 P, 647; 440/77

[56] References Cited

U.S. PATENT DOCUMENTS

| | | | |
|---|---|---|---|
| 3,395,684 | 8/1968 | Minks | 123/198 E |
| 3,556,069 | 1/1971 | Minks | 123/143 C |
| 4,721,485 | 1/1988 | Suzuki | 123/195 P |
| 4,933,809 | 6/1990 | Boede et al. | 440/77 |

*Primary Examiner*—Andrew M. Dolinar
*Attorney, Agent, or Firm*—Ernest A. Beutler

[57] ABSTRACT

A wiring arrangement for an outboard motor including a printed circuit board fitted within a magneto generator cover that is secured to the top of the engine of the outboard motor overlying the rotor. The printed circuit board has projecting portions that extend radially outward from a generally disk-shaped body for coupled connection with branch wires, one of which acts as an output line extending from a remote control unit within an associated watercraft. The other branch wires extend downwardly to supply power to various electrical components of the outboard motor.

4 Claims, 4 Drawing Sheets

WIRING ARRANGEMENT FOR ELECTRIC PARTS OF AN OUTBOARD MOTOR

BACKGROUND OF THE INVENTION

This invention relates to a wiring arrangement for the electric parts of an outboard motor, and more particularly to an improved wiring arrangement that includes a printed circuit board mounted on an upper portion of the engine and having a plurality of projecting portions which extend outwardly for connection with wires which, in turn, are connected to various electronic components of the engine.

Conventionally in outboard motors, the engine is contained within an engine compartment that is formed by a cowling that may include a tray and a removable top cowling having the general shape of an inverted cup. Many of the engine control parts, power tilt and trim control, and electrical parts such as the starter motor relay are mounted on the side wall of the engine and are contained with the cowling assembly. To provide power to these components, it has been the practice with outboard motors to employ wire harnesses which extend from the inside of the associated watercraft through the transom and into the empty spaces within the engine compartment where they are often distributed within the lower section of that compartment between an engine side wall and the cowling.

Although this type of wiring arrangement is generally satisfactory, it has certain disadvantages associated with it. Along pith the continued advancement in engine electronics, the number of electrical components for the engine has increased. As a result, the quantity and complexity of the wire harnesses has increased with the layout of the lower section of the engine compartment becoming more complicated. Also, by disposing the wire harnesses in the lower section of the engine compartment on or near the bottom of the cowling, there is a distinct possibility that the wires may come into contact with water that may have entered the interior of the cowling and collected at the bottom. This may result in corrosion of the wires and their connectors and possible electrical failure of the system. The possibility of corrosion is of particular concern when the outboard motor is operated in salt water.

Also, conventional wire harnesses have been so flexible that it is difficult to position them on the engine or within the cowling during assembly of the outboard motor.

It is, therefore, a principal object of this invention to provide an improved and simplified wiring arrangement for an outboard motor that includes a printed circuit board mounted in an upper section of the engine compartment and having branch wire connections for branch wires which extend downwardly to electrical components of the outboard motor.

It is another object of this invention to provide an improved and simplified wiring arrangement for an outboard motor which includes a printed circuit board and branch wires that may be readily connected and disconnected from the circuit board for maintenance and inspection purposes.

It is a further object of this invention to provide an improved and simplified wiring arrangement for an outboard motor which includes a printed circuit board having a less flexible form so as to facilitate the mounting of the circuit board.

SUMMARY OF THE INVENTION

This invention is adapted to be embodied in a wiring assembly for an outboard motor which includes an engine, a cowling defining an engine compartment in which the engine is contained and a cover member disposed in an upper section of the engine compartment. The wiring assembly comprises a printed circuit board contained within the cover and having a plurality of outwardly extending projecting portions. A plurality of connectors are provided, one for connection to each of the plurality of projecting portions on the printed circuit board. A plurality of branch wires, one attached to each of the connectors, extend from their respective connectors.

DETAILED DESCRIPTION OF THE PREFERRED EMBODIMENT OF THE INVENTION

Figure 1:
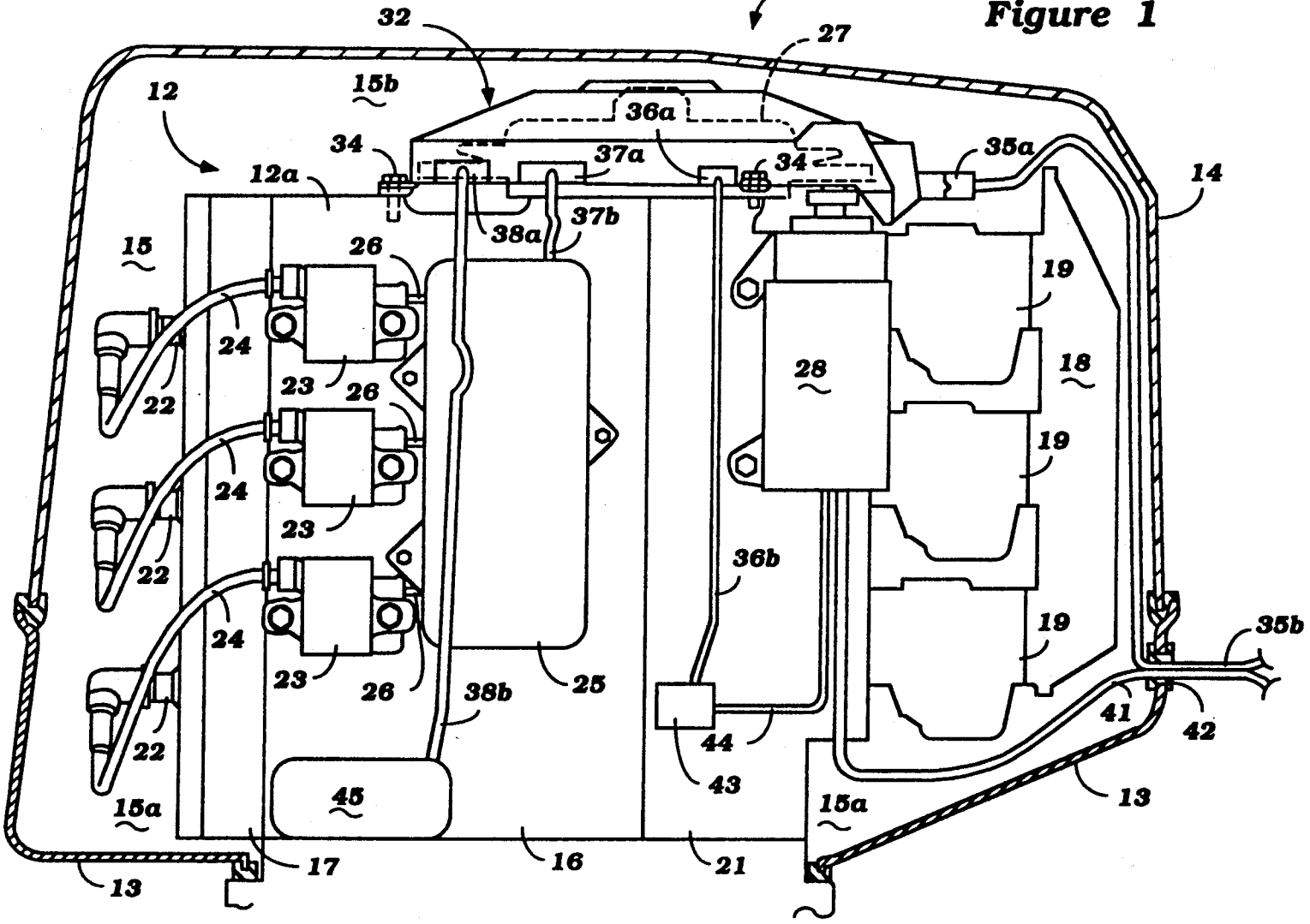
FIG. 1 is a side elevational view of the power head of an outboard motor taken from the starboard side with the cowling shown in cross section to reveal a portion of the engine.

Referring first to FIG. 1 of the drawings, the power head of an outboard motor constructed in accordance with an embodiment of the invention is identified generally by the reference numeral 11. The power head 11 comprises an internal combustion engine 12 that is surrounded by a protective cowling assembly which includes a lower tray portion 13 and a top cowling 14. The tray 13 and top cowling 14 cooperate in defining an engine compartment, identified by the reference numeral 15, where the engine 12 is contained. The engine compartment 15 includes a lower section **15*a* and an upper section 15*b***.

The engine 12 is comprised of a cylinder block 16 to which a cylinder head 17 is attached in a known manner. The engine 12 is also provided with an induction system that includes an air inlet device 18 that draws air in from the interior of the cowling 14 and delivers the air to a plurality of carburetors 19 through an intake manifold. The carburetors 19 supply a mixture of fuel and air to the engine 12 and specifically to the individual crank chambers formed in a crankcase which is formed by the cylinder block 16 and a crankcase assembly 21 that is affixed to the cylinder block 16.

An engine output shaft in the form of a crankshaft in the illustrated embodiment is journaled for rotation within the crankcase and drives a driveshaft journaled for rotation within a driveshaft housing (not shown) that depends from the power head 11. The driveshaft, in turn, drives a propeller of a lower unit (not shown) through a conventional forward, neutral, reverse transmission of any known type.

A spark plug 22 is provided for each cylinder of the engine 12 and is mounted in the cylinder head 17 in a known manner. The spark plugs 22 are fired by means of individual ignition coils 23, one of which is connected to each spark plug 22 by means of a spark plug wire 24. The ignition coils 23 are charged and triggered by means of an electronic ignition control device that includes a capacitor discharge ignition (CDI) unit and which is indicated by the reference numeral 25. Individual wires 26 interconnect each of the ignition coils 23 with the control device 25. The CDI unit includes means for controlling the ignition timing and the firing of the spark plugs 22.

The firing power for the spark plugs 22 is derived from a magneto generator assembly 2 which is driven by the engine 12 and which includes a rotor that is affixed to the upper end of the crankshaft by means of a nut and key. A flywheel is affixed on the outer periphery of the rotor.

The engine 12 is also provided with an electric starter motor 28 that is mounted on a side wall 12*a* of the engine 12 and has a starter gear with teeth that are enmeshed with the teeth formed on the flywheel for starting the engine 12 in a known manner.

Figure 2:
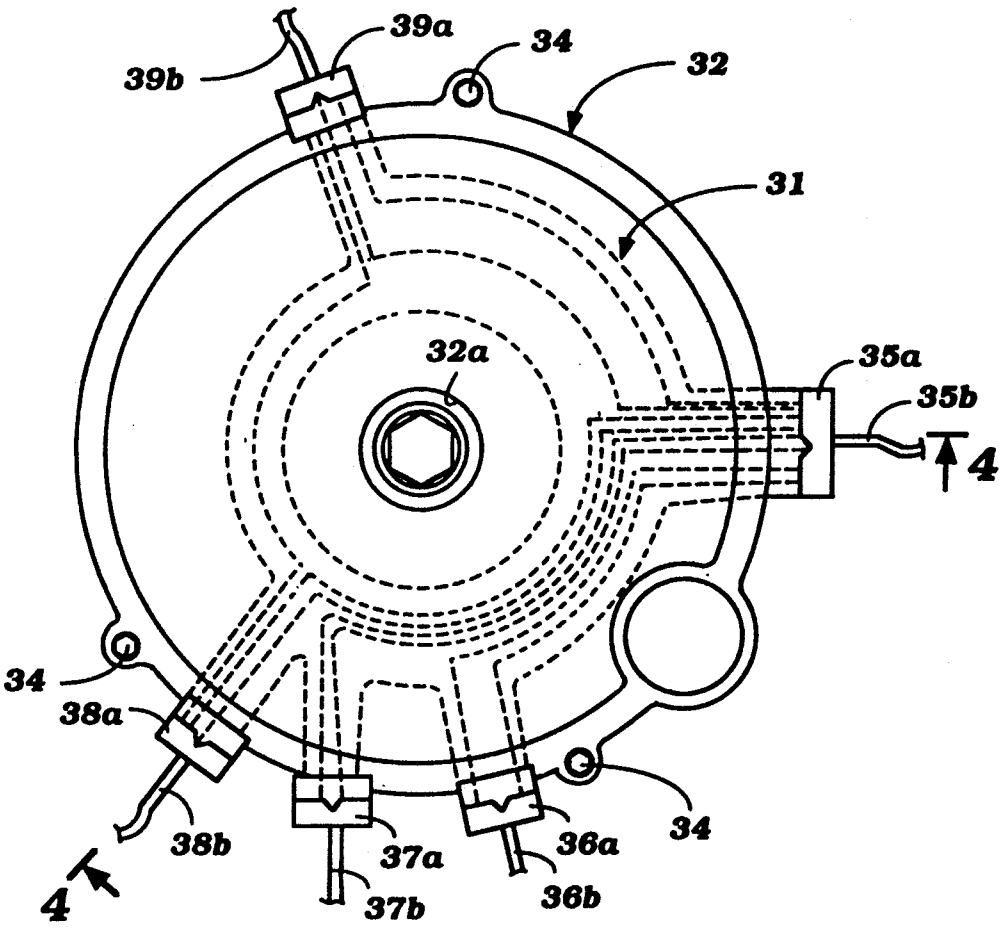
FIG. 2 is a top plan view of the engine showing the printed circuit board in phantom and its associated connectors for the branch wires.
Figure 3:
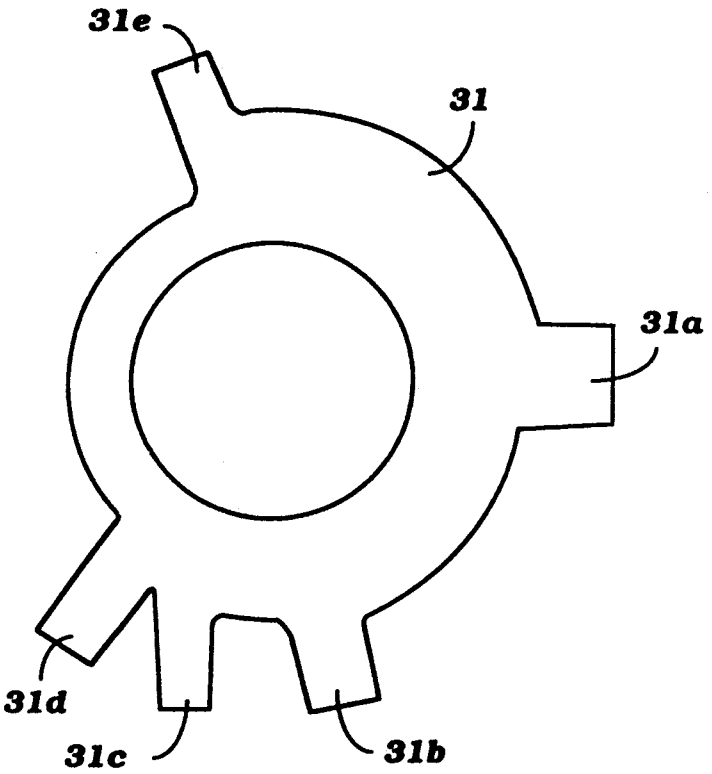
FIG. 3 is a top plan view of the printed circuit board.
Figure 4:
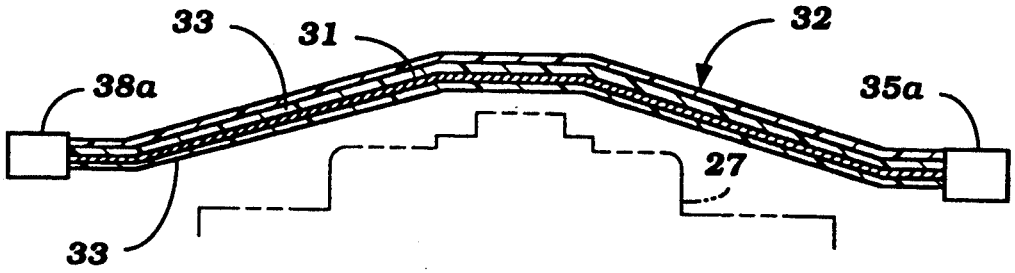
FIG. 4 is a cross sectional view taken along line 4—4 in FIG. 2.

Referring now to FIGS. 2, 3 and 4, in addition to FIG. 1, there is provided in accordance with the invention a printed circuit board identified generally by the reference numeral 31. As shown in FIGS. 2 and 3, this circuit board 31 has a generally disk-shaped body with outwardly extending projecting portions 31*a*, 31*b*, 31*c*, 31*d* and 31*e*. The circuit board 31 is contained within a magneto generator cover which is identified generally by the reference numeral 32 and which has the general shape of a shallow inverted bowl. The cover 32 has a raised center portion that overlies the rotor with an aperture 32*a* formed in the center of the cover 32 to accommodate the nut which affixes the magneto generator assembly 27 to the crankshaft. As shown in FIG. 4, the printed circuit board 31 is held in place within the cover 32 by means of a resin mold material 33 that is interposed between the circuit board 31 and the upper and lower inner surfaces of the cover 32.

The cover 32 has a plurality of attachment sections with apertures formed therethrough that are adapted to be aligned with corresponding apertures formed on the cylinder block 16 and crankcase assembly 21 when the cover 32 is appropriately positioned over the magneto generator assembly 27. The cover 32 is then secured to the engine 12 by means of bolts 34, each of which extends through a corresponding cover aperture and aperture in the engine 12.

The projecting portions 31*a* through 31*e* extend through slots formed at spaced locations in the outer periphery of the cover 32 and are adapted for connection to individual connectors 35*a*, 36*a*, 37*a*, 38*a* and 39*a* respectively of corresponding branch wires 35*b*, 36*b*, 37*b*, 38*b* and 39*b* each of which interconnects the circuit board 31 with a particular electrical component, as is hereinafter described.

The arrangement of the wiring assembly which runs from a battery and a remote control located within the associated watercraft (not shown) to the engine compartment 15 will now be described with reference to FIGS. 1, 2, 4 and 5. A battery cable 41 and an output line which corresponds to branch wire 35*b* extend from the battery and remote control through an opening in the side wall of the cowling tray 13 that is fitted with a rubber grommet 42 and into the engine compartment 15. The battery cable 41 then runs downwardly in the lower section 15*a* of the engine compartment 15 after which it extends upwardly for connection with the starter motor 28. After entering the engine compartment 15, the output cable 35*b* runs upwardly along the inner side wall of the top cowling 14 into the upper section 15*b* of the engine compartment 15 and then extends in a generally horizontal direction where it is connected through its connector 35*a* to the corresponding projecting portion 31*a* of the printed circuit board 31. Connector 35*a* may be removed from the projecting portion 31*a* for making and breaking the connection between the output line 35*b* and the circuit board 31 to facilitate assembly and disassembly for maintenance or inspection purposes.

It will be seen that each electrical line of the circuit board 31 shown in phantom in FIG. 2 runs radially inward from the outer edge of the projecting portion 31*a*, then runs in a generally circular direction on the body of the printed circuit board 31, and then at the appropriate position runs radially outward to terminate at another one of the projecting connector portions 31*b*, 31*c*, 31*d* or 31*e* of the circuit board 31.

Connectors 36*a*, 37*a*, 38*a* and 39*a* are connected to projecting portions 31*b*, 31*c*, 31*d* and 31*e* respectively for electrically connecting the branch wires 36*b*, 37*b*, 38*b* and 39*b* respectively with the printed circuit board 31. These connectors 36*a*, 37*a*, 38*a* and 39*a* are constructed in the same manner as connector 35*a* for connection and disconnection with the circuit board 31 to provide easy assembly and disassembly for maintenance or inspection purposes.

Figure 5:
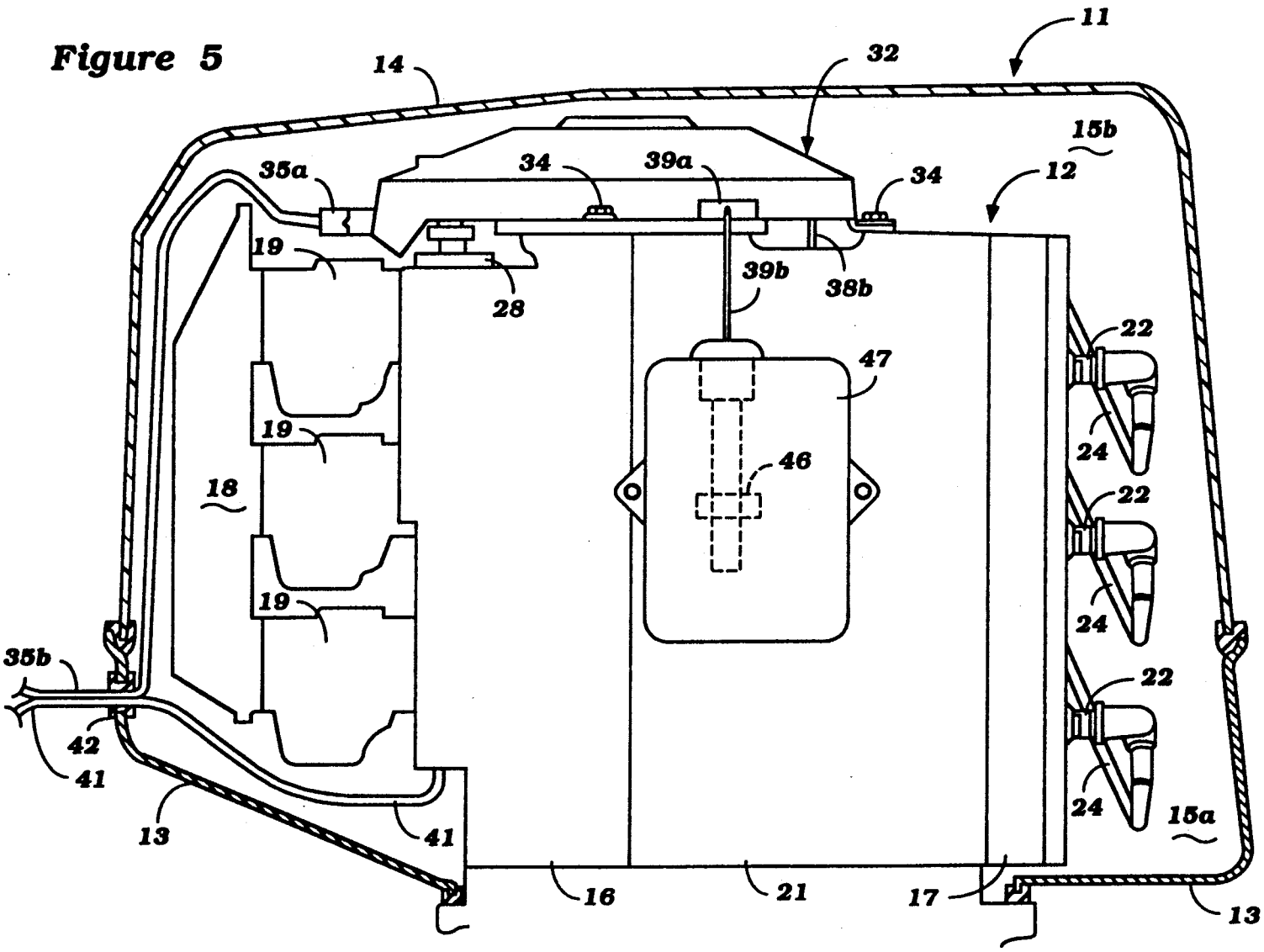
FIG. 5 is a side elevational view of the power head of the outboard motor taken from the port side with the cowling shown in cross section to reveal a portion of the engine.

As shown in FIGS. 1 and 5, each of these branch wires 36*b*, 37*b*, 38*b* and 39*b* extends to a different electrical engine component. Wire 36*b* runs down from the circuit board 31 to a starter relay 43 that is mounted on the side 12*a* of the engine 12 and connected to the starter motor 28 by way of a cable 44. Wire 37*b* extends down to interconnect the circuit board 31 with the electronic ignition control device 25 includes its CDI unit. A power tilt and trim relay 45 is also provided which is mounted on the side 12*a* of the engine 12 and which is connected to the printed circuit board 31 by branch wire 38*b*. The relay 45 is, in turn, connected by a wire cable to a motor (not shown) which effects power tilt and trim movement of the outboard motor. Wire 39*b* connects the circuit board 31 with an oil level gauge 46 in an oil tank 47 on the other side of the engine 12.

The wiring and the electrical components are assembled after the engine 12 is mounted within the power head 11. With the top cowling 14 removed, each electrical part is affixed to the cylinder block 16 or crankcase 21 with its input branch wire connected. The battery cable 41 and output cable 35*b* are routed from the watercraft into the engine compartment 15 through the grommet 42 and the battery cable 41 is connected to the starter motor 28. The magneto generator cover 32 with the printed circuit board 31 secured therein is placed on top of the engine 12 over the magneto generator 27 and is affixed to the engine by the bolts 34. The various input branch wires 36*b*, 37*b*, 38*b* and 39*b* from the various electrical parts are then connected by way of their respective connectors 36*a*, 37*a*, 38*a* and 39*a* to the corresponding projecting portions 31*b*, 31*c*, 31*d* and 31*e* of the printed circuit board 31. Remote control output 35*b* is then connected to the circuit board projecting portion 31*a* to complete the wiring connections. After that, the top cowling 14 is placed over the engine 12 and joined to the tray portion 13.

By employing this arrangement wherein one output wire 35*b* is connected to a printed circuit board 31 held in place at the top of the engine 12 with a individual branch wires running downwardly from the circuit board 31 for connection to the individual electrical components, the branch wires can be kept off of the bottom of the cowling tray 13. This greatly reduces the likelihood that the wires or their connectors will be damaged by any water which may have entered the engine compartment 15 and collected at the bottom of the cowling tray 13.

Using the printed circuit board 31 also simplifies the wiring arrangement. The circuit board 31 can be easily positioned so that its connecting portions 31*a* through 31*e* are in close proximity to the corresponding electrical part to avoid having to run wires from one side of the engine 12 to the other as is sometimes required in conventional units. This also makes connecting and disconnecting the branch wires 35*a* through 39*a* relatively easy and eliminates the need for fine positioning adjustments of the wire harness that is sometimes necessary in conventional units.

The circuit board 31 preferably has a sufficiently solid body so that it can be easily mounted.

In the illustrated embodiment, the printed circuit board 31 is attached to the magneto cover 32 with resin mold which has the advantage of allowing one to handle the circuit board 31 and cover 32 as a unit. The circuit board 31, however, may be a separate item from the magneto cover 32.

It should be readily apparent from the foregoing description that an improved wiring arrangement for an outboard motor has been illustrated and described. A printed circuit board is positioned in a magneto generator cover that is secured to the upper portion of the engine. An output branch wire from a remote control unit in the associated watercraft is connected to the circuit board as is a number of input branch wires which extend downwardly to various electrical parts of the engine. This reduces the possibility that the wiring will come into contact with water and also makes it easily accessible for maintenance purposes. Although an embodiment of the invention has been illustrated and described, various changes and modifications may be made without departing from the spirit and scope of the invention, as defined by the appended claims.

I claim:

1. A wiring assembly for an outboard motor including an engine, a cowling defining an engine compartment in which the engine is contained and a cover member disposed in an upper section of the engine compartment, said wiring assembly comprising a printed circuit board contained within the cover and having a plurality of outwardly extending projecting portions, said wiring assembly further comprising a plurality of connectors, one for connection to each of said plurality of projecting portions, and a plurality of branch wires, one attached to each of said connectors, extend from their respective connectors.

2. A wiring assembly as recited in claim 1, wherein the engine comprises a cylinder block, an output shaft having upper and lower ends and a magneto generator affixed to the upper end of said output shaft, and wherein said cover is secured to the cylinder block and is positioned above the magneto generator.

3. A wiring assembly as recited in claim 2, wherein said cover has a raised center portion having an aperture formed therein to accommodate the top of the output shaft.

4. A wiring assembly as recited in claim 1, wherein said printed circuit board is molded within the cover.

* * * * *